US007828507B2

(12) United States Patent
Honegger

(10) Patent No.: US 7,828,507 B2
(45) Date of Patent: Nov. 9, 2010

(54) STACK TURNING APPARATUS WITH MULTIPLE DRIVE MEANS TO STRAIGHTEN AND EJECT STACK FROM TURNTABLE

(75) Inventor: Werner Honegger, Bäch (CH)

(73) Assignee: Ferag AG, Hinwil (CH)

( * ) Notice: Subject to any disclaimer, the term of this patent is extended or adjusted under 35 U.S.C. 154(b) by 418 days.

(21) Appl. No.: 10/755,895

(22) Filed: Jan. 13, 2004

(65) Prior Publication Data

US 2004/0140607 A1 Jul. 22, 2004

(30) Foreign Application Priority Data

Jan. 14, 2003 (CH) ..... 0051/03

(51) Int. Cl.
*B65G 57/00* (2006.01)
*B65H 31/00* (2006.01)
*B65H 31/34* (2006.01)
*B65G 57/22* (2006.01)

(52) U.S. Cl. ..... 414/790.3; 414/788.9; 414/792.2; 414/900

(58) Field of Classification Search ..... 198/626.1, 198/725–728, 459.8, 459.1, 461.1, 461.3; 414/789.9, 788.6, 790.8, 790.9, 791, 792.2, 414/792.4, 792.8, 790.3, 789, 789.1, 907; 270/58.31, 221–223; 271/189
See application file for complete search history.

(56) References Cited

U.S. PATENT DOCUMENTS 3,532,230 A * 10/1970 Howdle et al. ..... 414/788.3
3,563,360 A * 2/1971 Wickersheim ..... 414/132
3,595,370 A * 7/1971 Fujishiro ..... 198/374
4,068,567 A 1/1978 Allison et al.
4,421,221 A * 12/1983 Pessina et al. ..... 198/369.1
4,547,112 A * 10/1985 Steinhart ..... 414/788.3
4,749,077 A * 6/1988 Sjogren ..... 198/412
5,002,456 A * 3/1991 Gosslinghoff ..... 414/788.3

(Continued)

FOREIGN PATENT DOCUMENTS

CH 567 996 A5 10/1975

(Continued)

OTHER PUBLICATIONS

Decision of corresponding European Application No. 03 029 874.9, dated May 20, 2009 (English translation).

(Continued)

*Primary Examiner*—Gregory W Adams
(74) *Attorney, Agent, or Firm*—Alston & Bird LLP

(57) ABSTRACT

An apparatus for forming stacks of flat objects 12, in particular printed products, comprises a compartment 10 which is mounted for selective rotation about a vertical axis and whose compartment space 10' is bounded on two mutually opposite sides by bounding elements 68, 72. In the ejection direction A, the compartment is bounded by upstream guide elements 66 and downstream guide elements 70. The flat objects 12 are fed to the compartment 10 from above and come to lie in a stack formed on the compartment base 28. The upstream guide elements 66 and downstream guide elements 70 can be moved independently of one another in order, firstly, to permit the ejection of the stack formed and, secondly, to permit the stacked objects 12 to be held firmly during the rotation of the compartment 10.

16 Claims, 3 Drawing Sheets

U.S. PATENT DOCUMENTS

| | | | | |
|---|---|---|---|---|
| 5,370,382 | A | 12/1994 | Wetter | |
| 5,387,077 | A * | 2/1995 | Yatsuka et al. | 414/791 |
| 5,433,582 | A * | 7/1995 | Medina | 414/788.3 |
| 5,533,860 | A * | 7/1996 | Gammerler | 414/789 |
| 5,699,651 | A * | 12/1997 | Miller et al. | 53/448 |
| 6,032,947 | A * | 3/2000 | Parker | 271/213 |
| 6,168,008 | B1 * | 1/2001 | Sting et al. | 198/461.3 |
| 6,497,320 | B2 * | 12/2002 | Kondo et al. | 198/502.3 |
| 6,585,262 | B2 * | 7/2003 | Nakanishi | 271/270 |
| 6,669,006 | B2 * | 12/2003 | Antoniazzi et al. | 198/461.1 |
| 6,698,576 | B2 * | 3/2004 | Hahnel et al. | 198/469.1 |
| 6,966,743 | B2 * | 11/2005 | Eugster | 414/790.3 |
| 2001/0042673 | A1 * | 11/2001 | Nakanishi | 198/419.3 |

FOREIGN PATENT DOCUMENTS

| | | | |
|---|---|---|---|
| CH | 609 306 | A5 | 2/1979 |
| EP | 0 586 802 | A1 | 3/1994 |
| JP | 04-308152 | A | 10/1992 |

OTHER PUBLICATIONS

Decision of corresponding European Application No. 03 029 874.9, dated May 20, 2009 (German language).

Brochure entitled "*Universo Stapelauslage 3644*", Müller Martini Marketing AG, 6 pages; English translation of No.'s (2 pages). (E1).

Brochure entitled "*Universo Stapelauslage 3644*", Müller Martini Marketing AG, 6 pages (German language). (E1).

Brochure entitled "*ZTM-Auslage Universo*", (Operating instructions ZTM delivery Universo 3644); Müller Martini Buchbinde-Systeme AG 8552 Felben; 57 pages; (3644.90XX.0). (E2).

Brochure entitled "*Spare Parts Catalogue Universo 3644*", Müller Martini Buchbinde-Systeme AG 8552 Felben, 76 pages; (3644.9000.99A). (E3).

Sales Statistics, 2 pages. (E4).

DANZAS shipping document, 1 page. (E5).

Invoice No. 90264938 to Müller Martini GmbH, 17 pages. (E6).

Installation Layout No. 0167.1499.0, 2 pages. (E7).

Work Identification, 9 pages. (E8).

Customer Order No. 460414 (screen printout), 11 pages. (E9).

Program printout, 8 pages. (E11).

Photos of stacking shaft, 1 page. (E12).

Office Action of corresponding Japanese Application No. 2004-006697, mailed Oct. 7, 2009 (Japanese).

Office Action of corresponding Japanese Application No. 2004-006697, mailed Oct. 7, 2009 (English translation).

* cited by examiner

STACK TURNING APPARATUS WITH MULTIPLE DRIVE MEANS TO STRAIGHTEN AND EJECT STACK FROM TURNTABLE

BACKGROUND OF THE INVENTION

The present invention relates to an apparatus for forming stacks of flat objects, such as printed products.

An apparatus of this type is disclosed in CH-A-567 996 and CH-A-609 306. A stack compartment which can be loaded at the top is closed at the bottom by a stack support. After each bundle has been supplied, the stack compartment together with the stack support is rotated through 180°. The stack compartment is assigned driver arrangements which can be driven in a reciprocating manner in order to push a finished stack away from the stack support.

Another apparatus for forming stacks is disclosed by EP-A-0 586 802 and the corresponding U.S. Pat. No. 5,370,382. Two stack-forming devices arranged beside each other are alternately supplied by means of a gripper conveyor with printed products to be stacked. Underneath a pre-stacking space, each stack-forming device has a compartment whose compartment space is bounded on two mutually opposite sides by guide strips. A compartment base which can be raised and lowered is in each case raised in order to pick up a part stack formed in the pre-stacking space, and then lowered again until the objects arranged on it are arranged below slide plates bounding the pre-stacking space. The compartment base, together with the guide strips, can be rotated through 180° in each case in order to form a finished stack, in which the part stacks are in each case arranged lying on one another offset through 180°. As a result, objects such as folded printed products which have a greater thickness in one edge region than at the opposite edge region can be stacked to form stable stacks. In order to eject a finished stack from the compartment, the compartment base is lowered completely and an ejector is moved into the compartment in the ejection direction.

It is an object of the present invention to provide an apparatus of the described type which ensures the formation of stable stacks with short cycle times under all circumstances.

SUMMARY OF THE INVENTION

The above and other objects and advantages of the invention are achieved by the provision of an apparatus which comprises a compartment which defines an upwardly open compartment space and which is bounded by a compartment base. At least one upstream guide element is positioned on the upstream side of the compartment space when viewed in an ejection direction, and at least one downstream guide element is positioned on the downstream side of the compartment space. A drive means is provided for ejecting a stack of printed products from the compartment space in the ejection direction and which comprises a first drive for moving the upstream guide element through the compartment space in the ejection direction, and a second drive for moving the downstream guide element out of the compartment space, and wherein the first drive and the second drive are independently operable.

The compartment is mounted for rotation about a central vertical axis, and the compartment base may be mounted for vertical reciprocation so that it can be raised or lowered by a lifting device.

The compartment space is bounded on all four sides, so that the objects fed into the compartment from above can be guided with play on all sides during their vertical movement in the compartment space. In addition, the stacked objects can nonetheless be held firmly in the compartment space by the upstream and downstream guide elements during any rotation of the compartment and in this way can be prevented from lateral displacement and rotation. Furthermore, the guide elements bounding the compartment upstream as viewed in the ejection direction are used for ejecting the finished stack from the compartment. The means for ejecting the respectively formed stack are thus associated with the compartment. This provides the possibility of beginning the ejection of a stack even while the compartment base is being lowered.

BRIEF DESCRIPTION OF THE DRAWINGS

The present invention will be described in more detail using an exemplary embodiment illustrated in the drawings, in which, purely schematically.

DETAILED DESCRIPTION OF THE PREFERRED EMBODIMENT

First of all, with reference to FIGS. 1 to 5, the construction and the functioning of a compartment 10 of an apparatus according to the invention for forming stacks from folded printed products 12 will be described. It should be pointed out that the apparatus is of course also suitable for stacking unfolded printed products and other flat objects.

Figure 4:
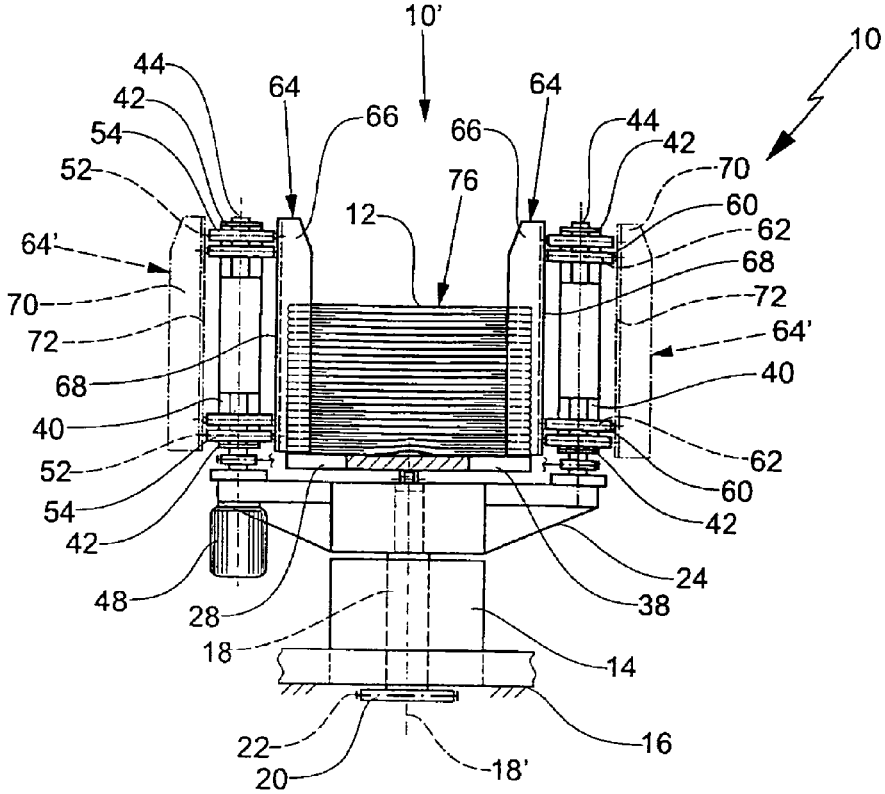
FIG. 4 is a side view in the direction of the arrow IV of FIG. 1 of the compartment shown in FIGS. 1 to 3.
Figure 5:
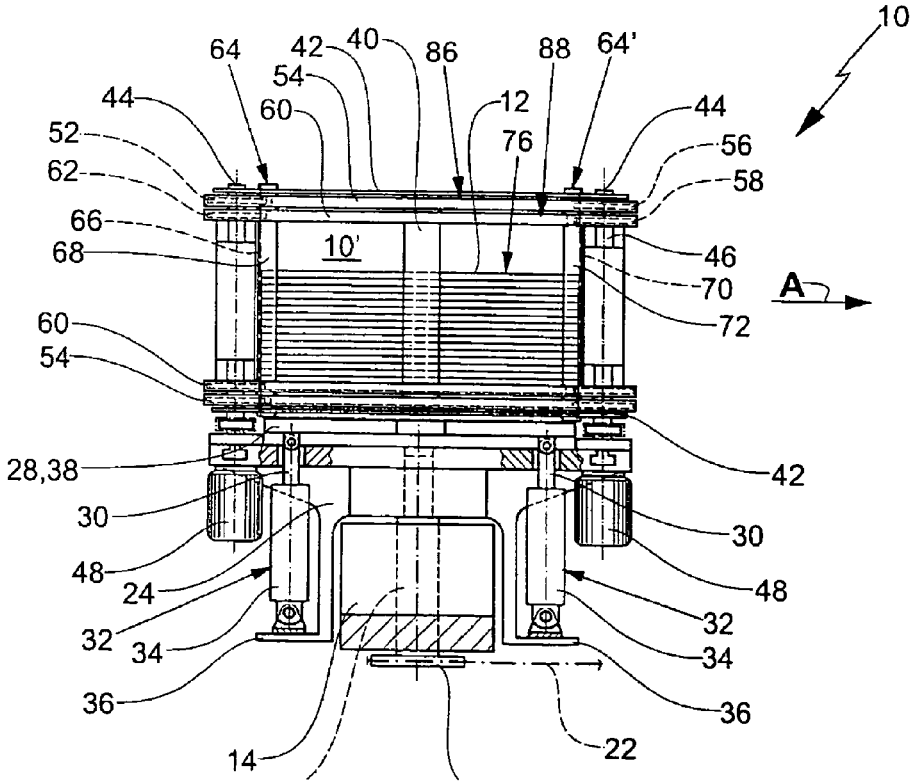
FIG. 5 is a view in the direction of the arrow V of FIG. 1 of the compartment shown in FIGS. 1 to 3.

As FIGS. 4 and 5 show, the substructure of the compartment 10 has a base 14 which is fixed to a stationary table 16 or floor. Mounted on the base 14 is a vertical-axis hollow shaft 18 on which, at the lower end, there is seated a sprocket 20 which, by means of a drive chain 22, is connected to a motor (not shown) for rotating the hollow shaft 18. A turntable 24 is firmly seated on the upper end of the hollow shaft 18 so as to rotate with it.

Figure 1:
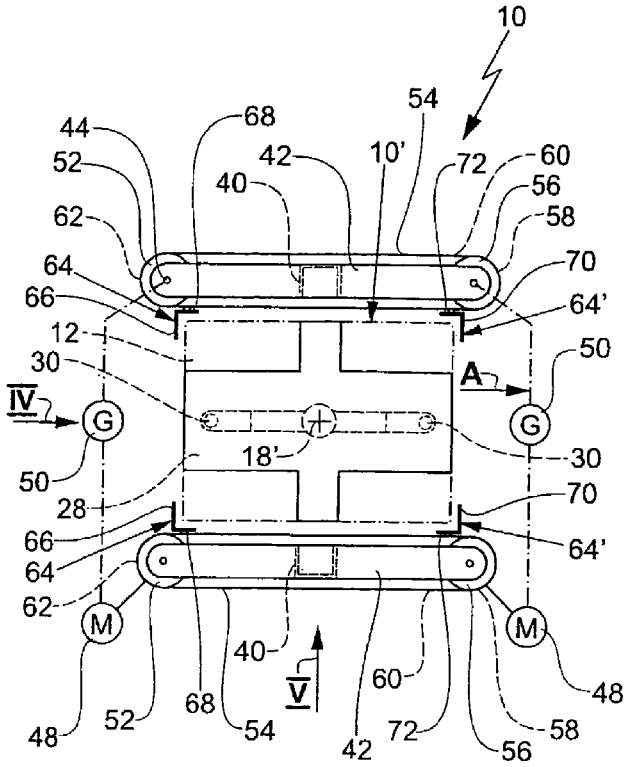
FIG. 1 is a top plan view showing a compartment of an apparatus according to the invention.
Figure 2:
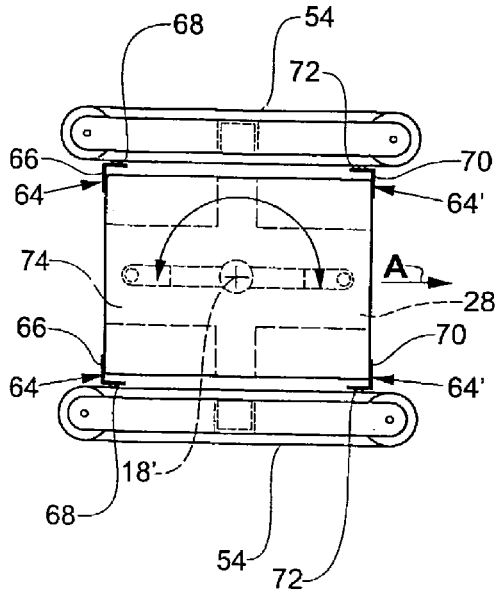
FIG. 2 shows, likewise in plan view, the compartment shown in FIG. 1 with objects arranged on the compartment base, ready for the rotation of the compartment through 180°.
Figure 3:
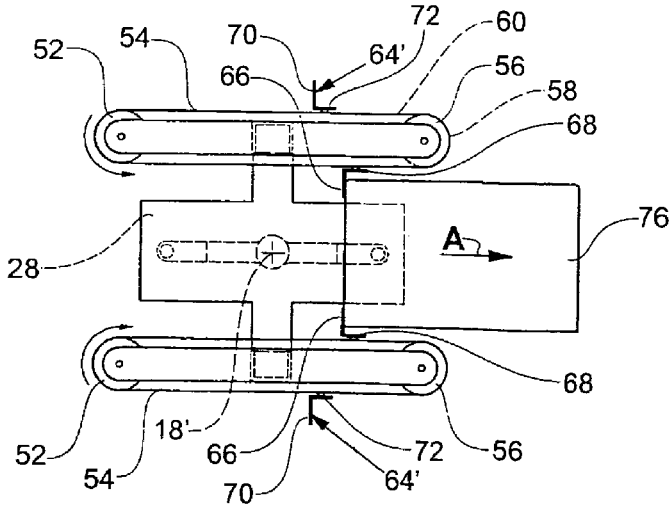
FIG. 3 shows, in the same illustration as FIGS. 1 and 2, the compartment during the ejection of a stack formed therein.

As revealed in particular by FIGS. 1 to 3, a compartment base 28 is arranged above the turntable 24 and firmly connected so as to rotate with the latter. The base 28 is of cross-shaped design, as viewed in plan view, and piston rods 30 of two cylinder-piston units 32 passing freely through the turntable 24 are attached at two points which are diametrically opposite each other with respect to the axis of rotation 18' of the hollow shaft. The cylinders 34 arranged underneath the turntable 24 and belonging to the cylinder-piston units 32 are in turn attached to carrier arms 36 projecting from the turntable 24. By means of the cylinder-piston units 32, the compartment base 28 can be raised from the lower end position 38 shown in FIGS. 4 and 5 and lowered into said position again.

On two mutually opposite sides outside the compartment space 10', the compartment 10, the compartment 10 in each case has a carrier 40 with a U-shaped cross section running in the vertical direction. In the free end regions of upper and lower plates 42 fixed to the two carriers 40 and running horizontally and parallel to each other, vertical bearing shafts 44 are freely rotatably mounted, each passing through a hollow bearing shaft 46. The two bearing shafts 44 arranged on one side as viewed in the ejection direction A are each connected to a drive motor 48. The opposite bearing shafts 44 corresponding to these bearing shafts 44 are likewise each connected via a reverse gear mechanism 50 to the associated drive motor 48. The two bearing shafts 44 arranged upstream as viewed in the ejection direction A can thus be driven synchronously and in opposite directions of rotation by means of one drive motor 48 and, likewise, by means of the other drive motor, so can the two bearing shafts 44 placed downstream.

In the upper and lower end region of the bearing shafts 44 placed upstream, in each case first sprockets 52, around which an endless first chain 54 is guided in each case, are firmly seated so as to rotate with the shafts. These four first chains 54 are further guided around second sprockets 56, which are freely rotatably mounted on the bearing shafts 44 placed downstream. The hollow bearing shafts 46 arranged between the two sprockets 56 are firmly connected to the bearing shafts 44 placed downstream so as to rotate with them, and upper and lower third sprockets 58 are firmly seated on 15 said shafts so as to rotate with them. In each case a second chain 60 engages around the said third sprockets 58 and is further guided around fourth sprockets 62 which are freely rotatably mounted upstream on the relevant hollow bearing shafts 46.

The first chains 54 arranged on both sides as viewed in the ejection direction A are each connected to each other via a vertical angle bracket 64. The legs of these two angle brackets 64, projecting at right angles 25 from the first chains 54, form upstream guide elements 66 and, in their positions as shown in FIGS. 1 to 5, project in the direction toward the compartment space 10'. The legs of the angle brackets 64 running parallel to the first chains 54 serve as lateral bounding elements 68, moved together with the guide elements 66, of the compartment space 10'.

In the same way, two further angle brackets 64' are fixed to the second chains 60, and form downstream guide elements 70 and, in their positions shown in FIGS. 1, 2, 4 and 5, project in the direction of the compartment space 10' and bound the latter on the downstream side as viewed in the ejection direction. In a corresponding way, the angle brackets 64' form further lateral bounding elements 72.

In FIG. 1, the format of the printed products 12 to be stacked is indicated in dash-dotted lines. This figure likewise reveals that, in order to form a stack, the angle brackets 64 and 64' have been brought by means of the motors 48 into a position in which the printed products 12 fed to the stacking space 10' from above can move with play in the vertical direction between the guide elements 66 and guide elements 70 and also the bounding elements 68 and further bounding elements 72. In this connection, it should be mentioned that the bounding brackets or else only selected ones of these, can be detachably fixed to the turntable 24 in order to be able to perform adaptation in the direction at right angles to the ejection direction A of the compartment space 10' to the format of the printed products 12 to be processed. Of course, the dimension of the compartment base 28, measured at right angles to the ejection direction, is chosen such that the compartment base 28 can be moved in the vertical direction without obstruction.

FIG. 2 shows a situation in which a part stack 74 is resting on the compartment base 28. By means of the drive motors 48, the guide elements 66 and guide elements 70 have been moved toward each other in or counter to the ejection direction A, so that these bear on the stack 74. As a result, the part stack 74 is held stably during rotation of the compartment 10 about the axis of rotation 18', as indicated by the double arrow.

If, following a rotation, further objects 12 are to be accommodated in the compartment space 10', the guide elements 66 and guide elements 70 are moved in the direction away from each other again into the position shown in FIG. 1. On the other hand, if the finished stack 76 formed is to be ejected following a rotation, the bounding elements 68 and further bounding elements 72 are moved directly in the ejection direction A, as explained below.

FIG. 3 shows the compartment 10 during the ejection of a finished stack 76 from the compartment 10 in the ejection direction A. For this purpose, starting from the situation as shown by FIG. 1 or FIG. 2, the first chains 54 and second chains 60 are driven in the ejection direction A, as a result of which, firstly, the guide elements 70 located downstream as viewed in the ejection direction A, together with the finished stack 76 and then, around the third sprockets 58, are moved out of the conveying area of the finished stack 76. At the time shown in FIG. 3, the further angle profiles 64' are already located on the outer return run of the second chains 60. Secondly, the guide elements 66 placed upstream eject the finished stack 76 from the compartment base 28, for example onto a delivery table or an output conveyor. Following the ejection of a finished stack 76, the angle brackets 64, 64' are again moved by means of the two drive motors 48 into the position shown in FIG. 1 for the formation of a next stack.

Since the angle brackets 64 and 64', and therefore the guide elements 66 and further guide elements 70 formed by these, are driven individually by their own drive motors 48, by activating these drive motors 48, adaptations, in the ejection direction A, to the format of the printed products 12 to be stacked can be performed in the most simple manner.

It is possible to feed the printed products 12 to be stacked directly to the compartment 10 for stacking, for example by means of a clamp transporter or belt conveyor. In a preferred way, however, the compartment 10 shown in FIGS. 1 to 5 and described further above is part of an apparatus as disclosed, for example, by EP-A-0 586 802 and the corresponding U.S. Pat. No. 5,370,382, in which part stacks 74 are formed in a pre-stacking space arranged above the compartment 10 and can be deposited on one another in the compartment space 10', in each case offset by 180° in relation to one another. With regard to the construction and functioning of such an apparatus, reference is expressly made to the two documents cited, which are incorporated herein by reference.

In FIGS. 6 to 9, in simplified form, an apparatus of this type equipped with a compartment 10 according to the invention is illustrated at five different times during an operating cycle. Of the compartment 10, for better clarity, only the compartment base 28 with the attached piston rods 30, the upstream guide element 66 and, in FIG. 6, also the downstream guide element 70 are shown. In the ejection direction A, the compartment 10 is followed by an output conveyor 78, for example constructed as a belt conveyor. This is intended to convey the finished stack 76 ejected in the ejection direction A away in the direction W leading away.

Arranged above the compartment 10 is a pre-stacking device 80 with a pre-stack compartment, not shown, which can be closed at the bottom by means of slide plates 82 which can be moved toward each other and away from each other. Above the slide plates 82, fork-like intermediate base elements 84 can be inserted into the pre-stack compartment and withdrawn from the latter again.

Figure 6:
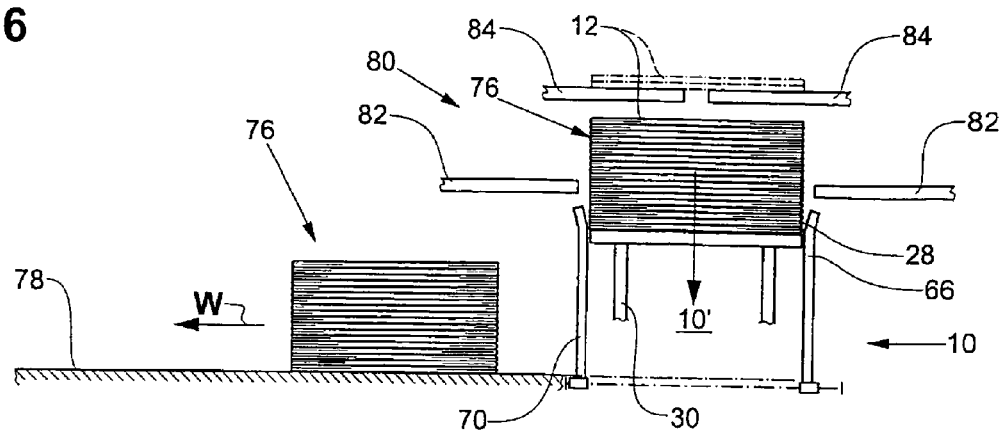
FIG. 6 is a schematic side view of an apparatus according to the invention and having a compartment according to FIGS. 1 to 5, and shown shortly after the formation of a finished stack at the start of the lowering of the compartment base.

At the time in a processing cycle shown in FIG. 6, a finished stack 76 is being transported away in the output conveying direction W by means of the output conveyor 78. A further finished stack 76 is resting on the raised compartment base 28. The further finished stack 76 has been formed in a known manner by depositing two part stacks 74 on each other with rotation of the compartment 10, carried out in between, together with the first part stack 74 already located in the compartment space 10', through 180°. The slide 20 plates 82 have been moved out of the pre-stacking space, while, in the meantime, printed products 12 fed in are being stacked on the inserted intermediate base elements 84. The compartment 10 is bounded upstream by the guide elements 66 and downstream by the guide elements 70.

Figure 7:
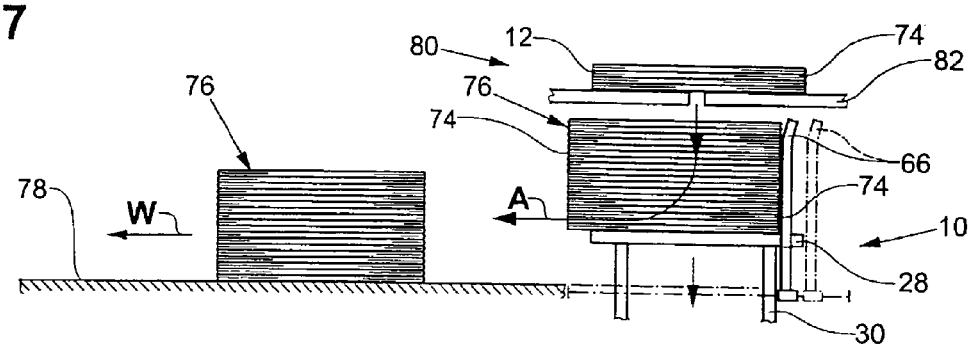
FIG. 7 shows, in the same illustration as FIG. 6, the apparatus shown there, the ejection of the stack and the formation of a pre-stack in a pre-stacking space already having been begun during the further lowering of the compartment base.

Even during the lowering of the compartment base 28, as soon as the entire finished stack 76 is located underneath the slide plates 82, the guide elements 66 and further guide elements 70 are moved in the ejection direction A, as shown by FIG. 7, as a result of which the guide elements 70 are moved around the third sprockets 58 (see FIG. 3) out of the movement path of the finished stack 76 to be ejected, into the region of the return run. The current position of the guide element 66 is illustrated by continuous lines, and dash-dotted lines indicate the position which it assumed in FIG. 6. The slide plates 82 were moved into the pre-stacking space after the top printed product 12 of the finished stack 76 had been lowered below the slide plates 82. Located on the slide plates 82 is the first part stack 74 of a next stack to be formed, which part stack 74 has arrived on the slide plates 82 as a result of the intermediate base elements 84 having been moved apart.

Figure 8:
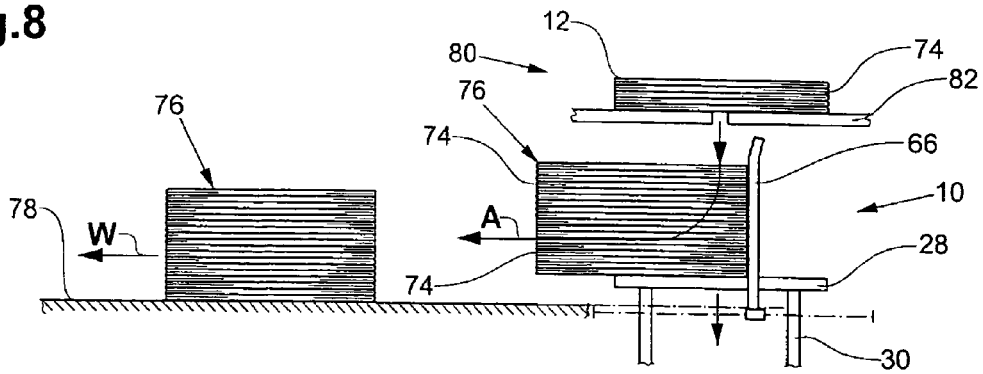
FIG. 8 shows, in the same illustration as FIGS. 6 and 7, the apparatus at a later time, at which the compartment base has been lowered further and the ejection of the stack has progressed further.
Figure 9:
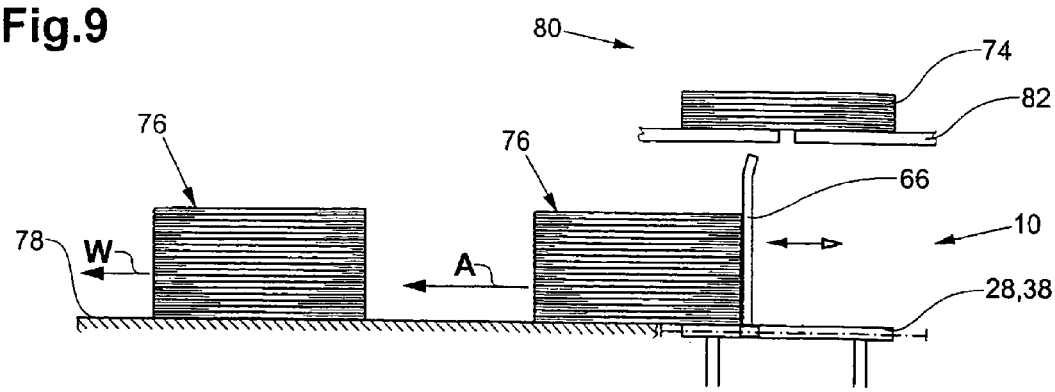
FIG. 9 shows, in the same illustration as FIGS. 6 to 8, the apparatus with the compartment base completely lowered shortly before completing the ejection operation.

At the time shown in FIG. 8, the compartment base 28 has been virtually completely lowered and the finished stack 76 has already been about one-third ejected from the compartment 10. As soon as the compartment base 28 has reached its lower end position 38, which is illustrated in FIG. 9, the complete ejection of the finished stack 76 from the compartment 10 is carried out. In the meantime, a further part stack 74 has been virtually completely created on the slide plates 82 and, following the subsequent raising of the compartment base 28, is transferred to the latter by moving the slide plates 82 apart. If part stacks are to be deposited on one another offset through 180°, before the deposition of a further part stack, the compartment 10 with the part stack located therein or the part stacks located therein is in each case rotated through 180° in a known manner.

The cross-shaped design of the compartment base 28 firstly ensures stable supporting of the stacks and secondly, when the compartment base 28 is raised, that the guide elements 66 and, if appropriate, the guide elements 70 will move past the arms of the compartment base 28 extending in and counter to the ejection direction.

A control device, not shown, controls all the drives 5 and functions, so that each finished stack 76 has the predetermined part stacks with the specific number of printed products.

The fact that the guide elements 66 serving as ejection elements are associated with the compartment 10 and thus the ejection operation can already be carried out as the compartment base 28 is lowered, means that shortening of the cycle times as compared with the known prior art is possible with gentle handling of the printed products 12.

In the embodiment of the compartment according to the invention shown in FIGS. 1 to 5, the drive elements 86 for the guide elements 66 are formed by first chains 54 guided around first and second sprockets 52, 56, and the further drive elements 88 for the further guide elements 70 are formed by second chains 60 guided around the third and fourth sprockets 58, 62. These drive elements 86, 88 can be formed in another way, for example by means of piston-cylinder arrangements, belt drives and so on.

The compartment according to the invention can be employed in different apparatuses for forming stacks of flat objects. This includes, for example, such apparatuses in which the stacks or part stacks are formed in the compartment itself.

As can be gathered from FIG. 4, the compartment base 28 can have at the center an elevation running in the ejection direction A, for example formed by freely rotatable rollers arranged one behind another, which further stabilizes the stacks and prevents the bottom printed product 12 projecting beyond the compartment base being able to bend downward during ejection.

The ejection of finished stacks 76 is also possible in the direction counter to the ejection direction A shown in FIGS. 1 to 3. For this purpose, the guide elements 66 and further guide elements 70 are driven in the opposite direction.

It is also possible to dispense with the hollow bearing shafts 46 and to arrange the third sprockets 58 firmly on the bearing shafts 44 so as to rotate with them, and to mount the fourth sprockets 62 freely rotatably on the bearing shafts 44.

That which is claimed:

1. A stacking apparatus for forming stacks of flat objects, such as printed products, comprising a compartment which defines an upwardly open compartment space and which is bounded by a compartment base, opposite upstream and downstream sides when viewed in an ejection direction, and opposite lateral sides, at least one upstream guide element on the upstream side of the compartment space, and at least one downstream guide element on the downstream side of the compartment space, said upstream guide element and said downstream guide element being arranged adjacent one of said lateral sides of the compartment, and said compartment being mounted for rotation about a central axis, a drive mechanism for ejecting a stack of printed products from the compartment space in the ejection direction comprising a first drive connected to the upstream guide element and a second drive connected to the downstream guide element, wherein the first drive and the second drive are independently operable, wherein the drive mechanism is configured to selectively move the upstream guide element and the downstream guide element in the ejection direction to eject a stack formed in the compartment and move the upstream guide element and the downstream guide element toward each other to at least approximately bear against the stack being formed in the compartment in order to stabilize it during rotation of the compartment about the central axis, wherein said compartment is further bounded by a pair of lateral bounding elements which lie on said one lateral side of the compartment space so as to be directly engageable with the stack of flat objects formed in the compartment space, with the lateral bounding elements being positioned adjacent respective ones of the upstream guide element and downstream guide element and driven by the drive mechanism so as to be moved together with the upstream guide element and the downstream guide element, respectively, during said selective movement.

2. The apparatus of claim 1 wherein said central axis extends vertically through the compartment and the apparatus further comprises a rotation drive for selectively rotating the compartment about said axis.

3. The apparatus of claim 2 wherein the drive mechanism is further configured to selectively move the upstream guide element and the downstream guide element away from each other to facilitate receipt of additional products in the compartment after it is rotated about said central axis.

4. The apparatus of claim 1 wherein the compartment base is mounted for vertical reciprocation so that it can be raised and lowered by a lifting device, and wherein the drive mechanism is configured to commence ejection of a stack while the stack is being lowered.

5. A stacking apparatus for forming stacks of flat objects, such as printed products, comprising a compartment which defines an upwardly open compartment space and which is bounded by a compartment base, opposite upstream and downstream sides when viewed in an ejection direction, and opposite lateral sides, at least one upstream guide element on the upstream side of the compartment space, and at least one downstream guide element on the downstream side of the compartment space, said upstream guide element and said downstream guide element being arranged adjacent one of said lateral sides of the compartment, and said compartment being mounted for rotation about a central axis, a drive mechanism for ejecting a stack of printed products from the compartment space in the ejection direction comprising a first drive connected to the upstream guide element and a second drive connected to the downstream guide element, wherein the first drive and the second drive are independently operable, wherein the drive mechanism is configured to selectively move the upstream guide element and the downstream guide element in the ejection direction to eject a stack formed in the compartment and move the upstream guide element and the downstream guide element toward each other to at least approximately bear against the stack being formed in the compartment in order to stabilize it during rotation of the compartment about the central axis, wherein said compartment is further bounded by a pair of lateral bounding elements which lie on said one lateral side of the compartment space so as to be directly engageable with the stack of flat objects formed in the compartment space, with the lateral bounding elements being positioned adjacent respective ones of the upstream guide element and downstream guide element and driven by the drive mechanism so as to be moved together with the upstream guide element and the downstream guide element, respectively, during said selective movement, and wherein a pair of the upstream guide elements are provided which define two upstream corners of the compartment, and wherein a pair of the downstream guide elements are provided which define two downstream corners of the compartment, and wherein the first drive comprises a first drive element on each side of the compartment for moving respective ones of the upstream guide elements and the second drive comprises a second drive element on each side of the compartment for moving respective ones of the downstream guide elements.

6. The apparatus of claim 5 wherein each of the first drive elements is connected to a first drive motor of the drive mechanism, and each of the second drive elements is connected to a second drive motor of the drive mechanism, and with the first and second drive motors being operable independently of each other.

7. The apparatus of claim 6 wherein each of the first drive elements comprises an endless drive belt mounted for movement about a pair of deflection wheels mounted adjacent the upstream and downstream ends of the compartment respectively, and wherein each of the second drive elements comprises an endless drive belt mounted for movement about a pair of deflection wheels mounted adjacent the upstream and downstream ends of the compartment respectively.

8. The apparatus of claim 5 wherein each of the upstream guide elements and each of the downstream guide elements is secured to one of said lateral bounding elements and so that the lateral bounding elements define the opposite lateral sides of the compartment space.

9. The apparatus of claim 8 wherein each of the upstream guide elements and the associated lateral bounding element form a right angle bracket which extends in the vertical direction, and wherein each of the downstream guide elements and the associated lateral bounding element form a right angle bracket which extends in the vertical direction.

10. A stacking apparatus for forming stacks of flat objects, such as printed products, comprising a compartment which defines an upwardly open compartment space and which is bounded by a compartment base upon which the flat objects are adapted to be received so as to form a stack thereof, with the compartment space being further bounded by opposite upstream and downstream sides when viewed in an ejection direction, and opposite lateral sides, at least one pair of lateral bounding elements forming one of the lateral sides of the compartment space and so as to be directly engageable with the stack of flat objects formed in the compartment space, at least one upstream guide element and at least one downstream guide element respectively forming the upstream and downstream sides of the compartment space, said upstream guide element and said downstream guide element being arranged adjacent said one lateral side of the compartment, and said compartment base being mounted for rotation about a central vertical axis and the apparatus further comprises a drive for selectively rotating the compartment by about 180° about said axis, and drive means for selectively (1) moving the upstream guide element and the downstream guide element both in the ejection direction to eject a stack formed in the compartment, and (2) moving the upstream guide element and the downstream guide element toward each other to at least approximately bear against the stack being formed in the compartment in order to stabilize the stack during rotation of the compartment, and wherein said at least one pair of lateral bounding elements are driven by the drive means so as to move together with the upstream guide element and the downstream guide element, respectively, during said selective movement.

11. The apparatus of claim 10 wherein the compartment base is mounted for vertical reciprocation so that it can be raised and lowered by a lifting device, and wherein the drive means is configured to commence ejection of a stack while the stack is being lowered.

12. The apparatus of claim 10 further comprising an intermediate product support positioned above said compartment base and means for mounting the intermediate product support for selective movement between an operative position to support an intermediate stack of products thereupon, and a laterally withdrawn position.

13. The apparatus of claim 12 wherein the intermediate product support comprises two members which are slideable toward and away from each other.

14. The apparatus of claim 10 wherein a pair of the upstream guide elements are provided which are respectively positioned adjacent two upstream corners of the compartment, and wherein a pair of the downstream guide elements are provided which are respectively positioned adjacent two downstream corners of the compartment.

15. The apparatus of claim 14 wherein the at least one pair of lateral bounding elements comprises a bounding element joined to each of the upstream and downstream guide members on the one side of the compartment space and a second pair of lateral bounding elements is provided which comprises a bounding element joined to each of the upstream and downstream guide members on the other side of the compartment space, so as to form an angle bracket at each of the four corners of the compartment space which extends in a vertical direction.

16. The apparatus of claim 15 wherein the drive means comprises a first drive element on each side of the compartment for mounting respective ones of the upstream guide elements and associated lateral bounding elements, and a second drive element on each side of the compartment for mounting respective ones of the downstream guide elements and associated lateral bounding elements.

* * * * *